US009617820B2

(12) United States Patent
Helvenston et al.

(10) Patent No.: US 9,617,820 B2
(45) Date of Patent: Apr. 11, 2017

(54) FLEXIBLE EMERGENCY HANGER AND METHOD OF INSTALLATION

(71) Applicant: GE Oil & Gas Pressure Control LP, Houston, TX (US)

(72) Inventors: Andrew Browne Helvenston, Houston, TX (US); Eugene Allen Borak, Houston, TX (US); Christopher Taylor Herman, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 0 days.

(21) Appl. No.: 14/794,065

(22) Filed: Jul. 8, 2015

(65) Prior Publication Data

US 2017/0009547 A1 Jan. 12, 2017

(51) Int. Cl.
*E21B 33/04* (2006.01)

(52) U.S. Cl.
CPC ..... *E21B 33/0422* (2013.01)

(58) Field of Classification Search
CPC ..... E21B 33/04; E21B 33/0422
See application file for complete search history.

(56) References Cited

U.S. PATENT DOCUMENTS 2,874,437 A 2/1959 Anderson
4,154,298 A * 5/1979 Gano ..... E21B 23/06 166/243
4,691,781 A * 9/1987 Gano ..... E21B 23/002 166/368
4,869,319 A * 9/1989 Szymozak ..... E21B 33/04 166/115
4,982,795 A 1/1991 King
5,287,922 A 2/1994 Bridges
6,095,242 A * 8/2000 Lequang ..... E21B 33/0422 166/368

(Continued)

FOREIGN PATENT DOCUMENTS

WO 2013158030 A1 10/2013

OTHER PUBLICATIONS

European Search Report and Opinion issued in connection with corresponding European Application No. 16178587.8 on Nov. 29, 2016.

*Primary Examiner* — Matthew R Buck
*Assistant Examiner* — Aaron Lembo
(74) *Attorney, Agent, or Firm* — Hogan Lovells US LLP

(57) ABSTRACT

A hanger assembly for supporting a tubular member within an outer well member includes a slip bowl that is moveable between an expanded condition with an enlarged diameter and a contracted condition with a reduced diameter, and has a downward facing slip bowl shoulder on an outer diameter of the slip bowl. Slips with teeth on an inner diameter surface are carried by the slip bowl. The slips are moveable between a retracted position, and an extended position where the teeth protrude radially inward from the inner diameter of the slip bowl. A false bowl has a lower upward facing false bowl shoulder located on an inner diameter and is sized to selectively engage the downward facing slip bowl shoulder. The false bowl also has a downward facing landing shoulder located on an outer diameter that is sized to selectively engage a support shoulder of the outer well member.

20 Claims, 3 Drawing Sheets

(56) References Cited

U.S. PATENT DOCUMENTS 6,367,558 B1 * 4/2002 Borak, Jr. ..... E21B 33/04 166/181
6,488,084 B1 * 12/2002 Borak, Jr. ..... E21B 33/0422 166/208
8,485,262 B1 * 7/2013 Angers ..... E21B 33/043 166/339
9,140,046 B1 * 9/2015 Kuhl ..... E05D 15/244
9,341,039 B2 * 5/2016 Galle ..... E21B 33/04
2002/0100596 A1 * 8/2002 Nguyen ..... E21B 33/038 166/382
2002/0174991 A1 * 11/2002 Borak, Jr. ..... E21B 33/035 166/378
2005/0167095 A1 * 8/2005 Nguyen ..... E21B 33/0422 166/88.2
2005/0284640 A1 * 12/2005 Borak, Jr. ..... E21B 33/047 166/369
2006/0102337 A1 * 5/2006 Elliott ..... E21B 19/07 166/77.51
2007/0272420 A1 * 11/2007 Reimert ..... E21B 23/04 166/387
2010/0147533 A1 * 6/2010 Nelson ..... E21B 33/04 166/379
2010/0319927 A1 * 12/2010 Yokley ..... E21B 23/04 166/373
2011/0108275 A1 * 5/2011 Borak ..... E21B 17/1007 166/308.1
2012/0097390 A1 * 4/2012 Howell ..... E21B 17/20 166/277
2012/0125634 A1 * 5/2012 Guitierrez ..... E21B 33/072 166/382
2012/0205111 A1 * 8/2012 Udipi ..... E21B 43/26 166/308.1
2013/0146306 A1 * 6/2013 Yates ..... E21B 33/0422 166/382
2014/0020900 A1 * 1/2014 Nguyen ..... E21B 43/26 166/308.1
2014/0131954 A1 * 5/2014 Koleilat ..... F16J 15/068 277/336
2014/0151069 A1 * 6/2014 Kajaria ..... E21B 33/047 166/382
2014/0352977 A1 * 12/2014 Borak, Jr. ..... E21B 33/04 166/379
2015/0114654 A1 * 4/2015 Monjure ..... E21B 41/00 166/311
2016/0060994 A1 * 3/2016 Liew ..... E21B 19/10 166/379
2016/0090801 A1 * 3/2016 Hazelip ..... E21B 33/0422 166/382

* cited by examiner

FLEXIBLE EMERGENCY HANGER AND METHOD OF INSTALLATION

BACKGROUND

1. Field of Disclosure

This disclosure relates in general to wellhead assemblies, and in particular to a hanger for supporting a tubular member within a wellhead assembly.

2. Description of Related Art

When drilling and completing subterranean wells, such as wells used for hydrocarbon production, successive joints of tubular members are run into the well through a wellhead. The successive joints of tubular members can be connected together with collars. Collars generally have a larger outer diameter than the outer diameter of the tubular members. There can be times when the tubular members become stuck and cannot move upwards or downwards. In such a situation, the tubular member may not be able to be supported by the wellhead by the planned or existing support mechanism and a backup or emergency support for the tubular member is required.

Current methods for providing such backup or emergency support can include cutting off the tubular member within the outer well member and installing slips over an end of the tubular member that can land on a support shoulder in the outer well member and grip the tubular member. After cutting the tubular member, the tubular member can remain suspended within the outer well member without being secured or supported, providing a possibility of the tubular member falling within the outer well member and causing potential damage to the well, creating a possible safety and environmental risk, and requiring time and money to retrieve the fallen tubular member.

If the tubular member is not cut, a collar may be located along the tubular member above the support shoulder. The slips will need to have a sufficiently large inner diameter to pass by such a collar and still be able to grip the tubular member having a smaller outer diameter. Some current slip hangers used to pass over a collar are expandable. However when the expandable slip hanger and slips contract to grip the tubular member, there is a gap between the outer diameter of the slip hanger and the inner diameter of the outer well member. As such, the slip hanger can move radially outward and the slips can potentially lose their grip on the tubular member.

SUMMARY OF THE DISCLOSURE

Embodiments of the current disclosure provide systems and methods for supporting a tubular member within an outer well member with a hanger assembly that is capable of being flexed around a collar during installation in the well. The hanger assembly is secured radially within the outer well member with a false bowl and can be installed in a single trip. The tubular member is not ever in freestanding mode but instead is always supported. Systems and methods described herein can be utilized in tight wellhead spaces.

In an embodiment of this disclosure, a hanger assembly for supporting a tubular member within an outer well member having a central axis is disclosed. The hanger assembly includes a slip bowl. The slip bowl is a cylindrical member moveable between an expanded condition with an enlarged diameter and a contracted condition with a reduced diameter. The slip bowl has a downward facing slip bowl shoulder on an outer diameter of the slip bowl. Slips are carried by the slip bowl. The slips have teeth on an inner diameter surface of the slips. The slips are moveable between a retracted position where an innermost diameter of the teeth is greater than an inner diameter of the slip bowl, and an extended position where the teeth protrude radially inward from the inner diameter of the slip bowl. The hanger assembly further includes a false bowl. The false bowl is a cylindrical member having a lower upward facing false bowl shoulder located on an inner diameter of the false bowl and sized to selectively engage the downward facing slip bowl shoulder. The false bowl also has a downward facing landing shoulder located on an outer diameter and is sized to selectively engage a support shoulder of the outer well member.

In an alternate embodiment of this disclosure, a hanger assembly for supporting a tubular member within an outer well member having a central axis is disclosed. The hanger assembly includes a slip bowl. The slip bowl is moveable between an expanded condition with an enlarged diameter and a contracted condition with a reduced diameter. The slip bowl has a downward facing slip bowl shoulder on an outer diameter of the slip bowl. Slips are carried by the slip bowl. The slips have teeth on an inner diameter surface of the slips. The hanger assembly further includes a false bowl. The false bowl has a lower upward facing false bowl shoulder located on an inner diameter of the false bowl and sized to selectively engage the downward facing slip bowl shoulder. The false bowl also has a downward facing landing shoulder located on an outer diameter and is sized to selectively engage a support shoulder of the outer well member. An installation tool is releasably secured to the false bowl. The installation tool has a hydraulic action arm and an inner hydraulic arm. The hydraulic action arm has a downward facing surface that engages an upward facing surface of the false bowl, and selectively retains the slip bowl in the expanded condition.

In another alternate embodiment of this disclosure, a method for supporting a tubular member within an outer well member having a central axis is disclosed. The method includes providing a hanger assembly. The hanger assembly has a slip bowl, slips carried by the slip bowl, and a false bowl. The slip bowl is a cylindrical member moveable between an expanded condition with an enlarged diameter and a contracted condition with a reduced diameter. The slips are moveable between a retracted position where an innermost diameter of teeth of the slips located on an inner diameter surface of the slips is greater than an inner diameter of the slip bowl, and an extended position where the teeth protrude radially inward from the inner diameter of the slip bowl. The false bowl is a cylindrical member. The hanger assembly is inserted into the outer well member with an installation tool, the installation tool retaining the slip bowl in the expanded condition. The slip bowl is released from the installation tool so that a downward facing slip bowl shoulder on an outer diameter of the slip bowl engages a lower upward facing false bowl shoulder located on an inner diameter of the false bowl and the slip bowl moves to the contracted condition. The false bowl is released from the installation tool so that a downward facing landing shoulder located on an outer diameter of the false bowl engages a support shoulder of the outer well member and the slips are in an extended position for gripping and supporting the tubular member.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
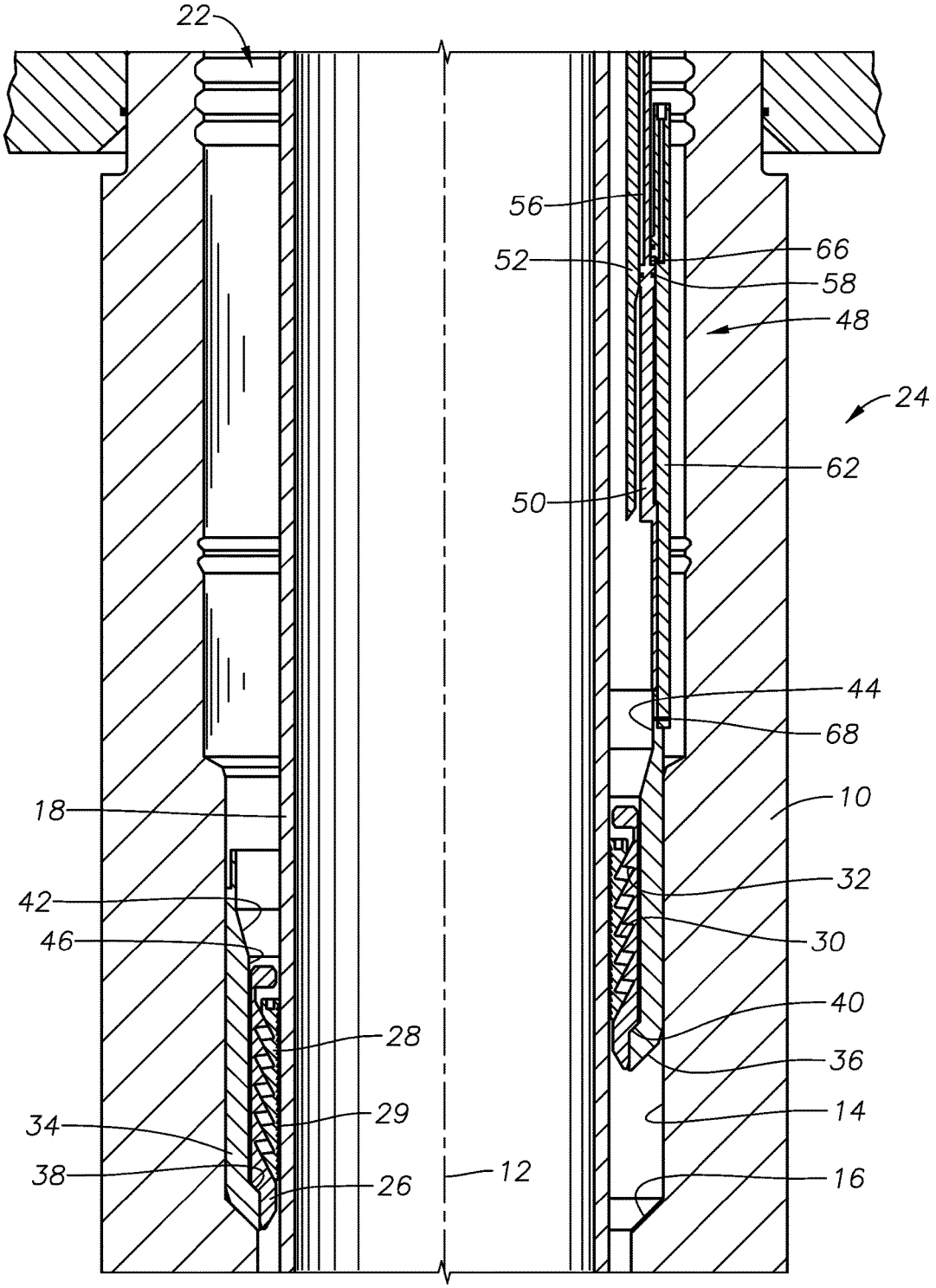
FIG. 1 is a section view of a hanger assembly in accordance with an embodiment of this disclosure, shown located within an outer well member and shown in an engaged position on the left hand side of FIG. 1, and in an unengaged position on the right hand side of FIG. 1.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 2:
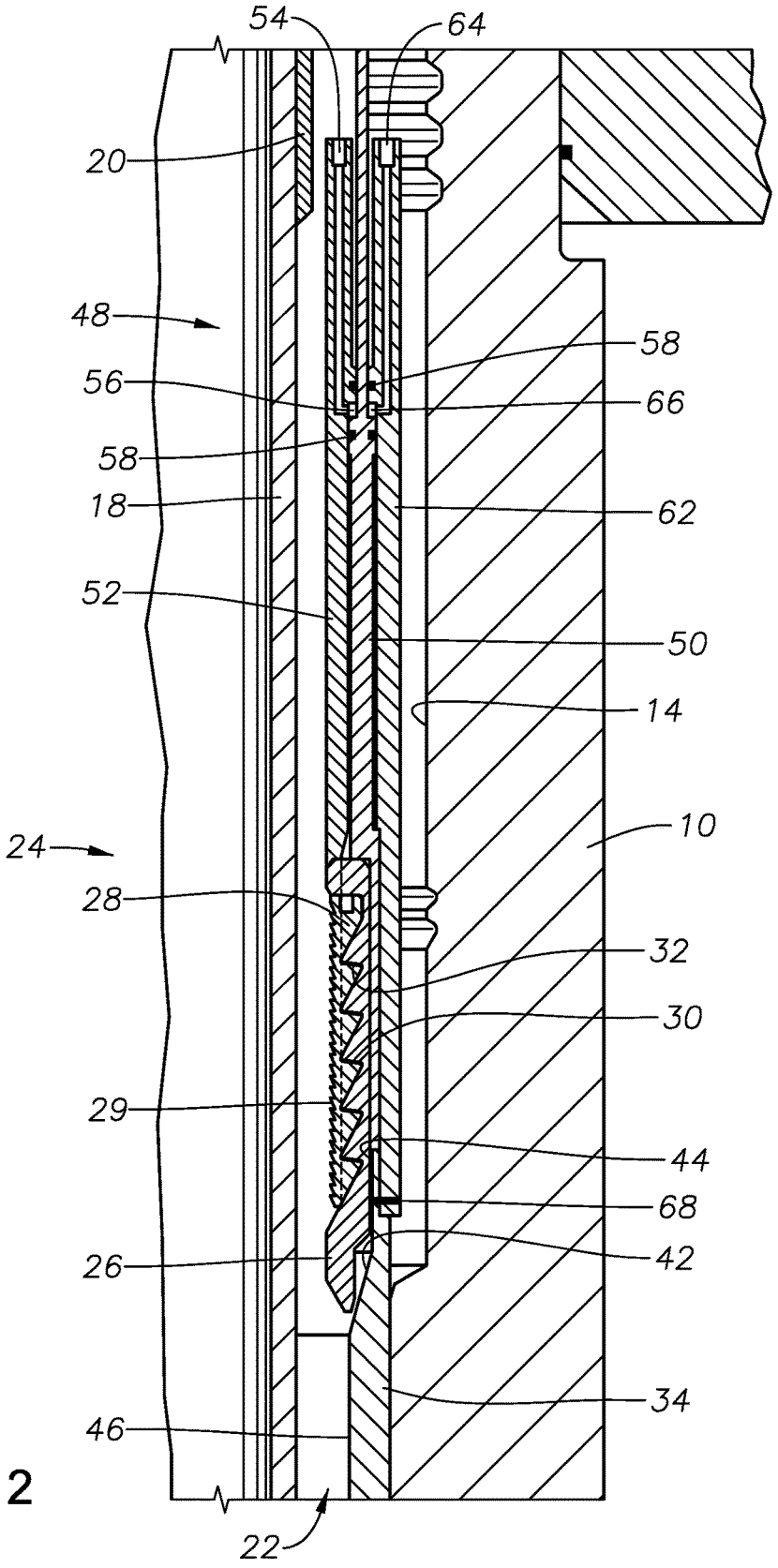
FIG. 2 is a section view of the hanger assembly of FIG. 1, shown with the slip bowl in the expanded condition.

Referring to FIGS. 1 and 2, outer well member 10 has a central axis 12. Outer well member 10 can be a tubular member such as a wellhead assembly or multibowl assembly and can be associated with a subterranean well and part of an onshore development or part of an offshore development that located above the water. Outer well member 10 has an inner diameter that defines a central bore 14. Support shoulder 16 is located on the inner diameter of outer well member 10 and can have a sloped and generally upward and outward facing annular surface.

Tubular member 18 extends through outer well member 10 and into the well. Tubular member 18 can be formed of a series of lengths or joints of cylindrical pipe or tubing that are connected together end to end with collars 20. During installation of tubular member 18 within outer well member 10, tubular member 18 can become stuck with collar 20 located axially above support shoulder 16. Annular space 22 is defined between an outer diameter of tubular member 18 and the inner diameter of bore 14 of outer well member 10.

Hanger assembly 24 can be lowered into annular space 22 over a top end of tubular member 18. Hanger assembly 24 includes slip bowl 26. Slip bowl 26 is a cylindrical member that circumscribes tubular member 18 and is moveable between an expanded condition with an enlarged diameter (FIG. 2) and a contracted condition with a reduced diameter (FIG. 1). In the expanded condition, the inner diameter of slip bowl 26 is larger than the outer diameter of collar 20 so that hanger assembly 24 can move axially within annular space 22 past collar 20.

Slips 28 are carried by slip bowl 26. Slips 28 can include a series of individual slip segments that are separated from each other radially and together form a generally cylindrical shape. Slips 28 have teeth 29 on an inner diameter surface of slips 28. Teeth 29 can be defined by rows of grooves cut into the inner diameter surface of slips 28 that can grip tubular member 18. Teeth 29 can be angled upward so that teeth 29 can better grip and support tubular member 18 when tubular member 18 is exerting a downward force relative to hanger assembly 24. As an example, teeth 29 that are angled upwards can more efficiently support a weight of tubular member 18.

Slips 28 can have an outer diameter profiled surface 30 that mates with inner diameter profiled surface 32 of slip bowl 26. The shape of outer diameter profiled surface 30 and inner diameter profiled surface 32 is such that as hanger assembly 24 moves axially downward within annular space 22, slips 28 can be held in a refracted position where an innermost diameter of teeth 29 is greater than an inner diameter of slip bowl 26 (FIG. 2). In the retracted position, teeth 29 will therefore not engage an outer surface of tubular member 18 but can instead pass by the outer diameter of tubular member 18 and collar 20 without contacting tubular member 18 or collar 20.

The shape of outer diameter profiled surface 30 and inner diameter profiled surface 32 can also be such that slips 28 can, under the force of gravity, fall downward relative to slip bowl 26 to an extended position where teeth 29 protrude radially inward from the inner diameter of slip bowl 26 (FIG. 1). If tubular member 18 exerts a downward force relative to slip bowl 26 when slip bowl 26 is in an expanded condition, and slips 28 are in an extended position, slips 28 will be pushed radially inward by the interaction of profiled surfaces 30, 32 and teeth 29 will tend to more tightly grip tubular member 18 (FIG. 1, left side). In the example embodiments of FIGS. 1-2, outer diameter profiled surface 30 of slips 28 have downward facing sloped surfaces that mate with upward facing sloped surfaces of inner diameter profiled surface 32 of slip bowl 26, however in alternate embodiments other shapes for profiled surfaces 30, 32 can be used that allow teeth 29 to engage tubular member 18 as needed.

Slips 28 can be mechanically connected to slip bowl 26 in such a way as to allow slips 28 sufficient axial and radial movement relative to slip bowl 26 to allow slips 28 to move between the retracted position and the extended condition, while preventing slips 28 from falling out of slip bowl 26 during or before the installation of hanger assembly 24 into annular space 22.

Looking at FIG. 1, hanger assembly 24 also includes false bowl 34. False bowl 34 is a cylindrical member having downward facing landing shoulder 36 located on an outer diameter. Downward facing landing shoulder 36 is sized to selectively engage support shoulder 16 of outer well member 10. False bowl 34 also has lower upward facing false bowl shoulder 38 that is located on an inner diameter of false bowl 34. Lower upward facing false bowl shoulder 38 is sized to selectively engage downward facing slip bowl shoulder 40. Downward facing slip bowl shoulder 40 is located on an outer diameter of slip bowl 26.

False bowl 34 additionally has upper upward facing false bowl shoulder 42 that is located on an inner diameter of false bowl 34. False bowl 34 has a region with a larger inner diameter 44 above upper upward facing false bowl shoulder 42. Looking at FIG. 1, when slip bowl 26 is located axially above upper upward facing false bowl shoulder 42, the region of false bowl 34 with the larger inner diameter 44 circumscribes a portion of slip bowl 26 and slip bowl 26 can be in the expanded condition. Looking at FIG. 1, false bowl 34 has a region with a smaller inner diameter 46 below upper upward facing false bowl shoulder 42. When slip bowl 26 is located within the region with a smaller inner diameter 46, slip bowl 26 is in the contracted condition and the region with the smaller inner diameter 46 circumscribes slip bowl 26. Upper upward facing false bowl shoulder 42 has a sloped surface for engaging an outer surface of slip bowl 26 as slip bowl 26 moves axially relative to false bowl 34. The engagement of the outer surface of slip bowl 26 along upper upward facing false bowl shoulder 42 can help to transition slip bowl 26 from the expanded condition (FIG. 2) to the contracted condition (FIG. 1).

False bowl 34 is sized so that when false bowl 34 is landed on support shoulder 16 of outer well member 10, there is no excess space between the outer diameter of false bowl 34 and the inner diameter of outer well member 10. In this way, when slip bowl 26 is landed on lower upward facing false bowl shoulder 38, false bowl 34 cannot move radially within outer well member 10 and false bowl 34 can provide a stable radial support for slip bowl 26 within outer well member 10. False bowl 34 can take up any radial space that would exist between the outer diameter of slip bowl 26 and the inner diameter of outer well member 10 when slip bowl 26 is in the contracted condition.

Figure 3:
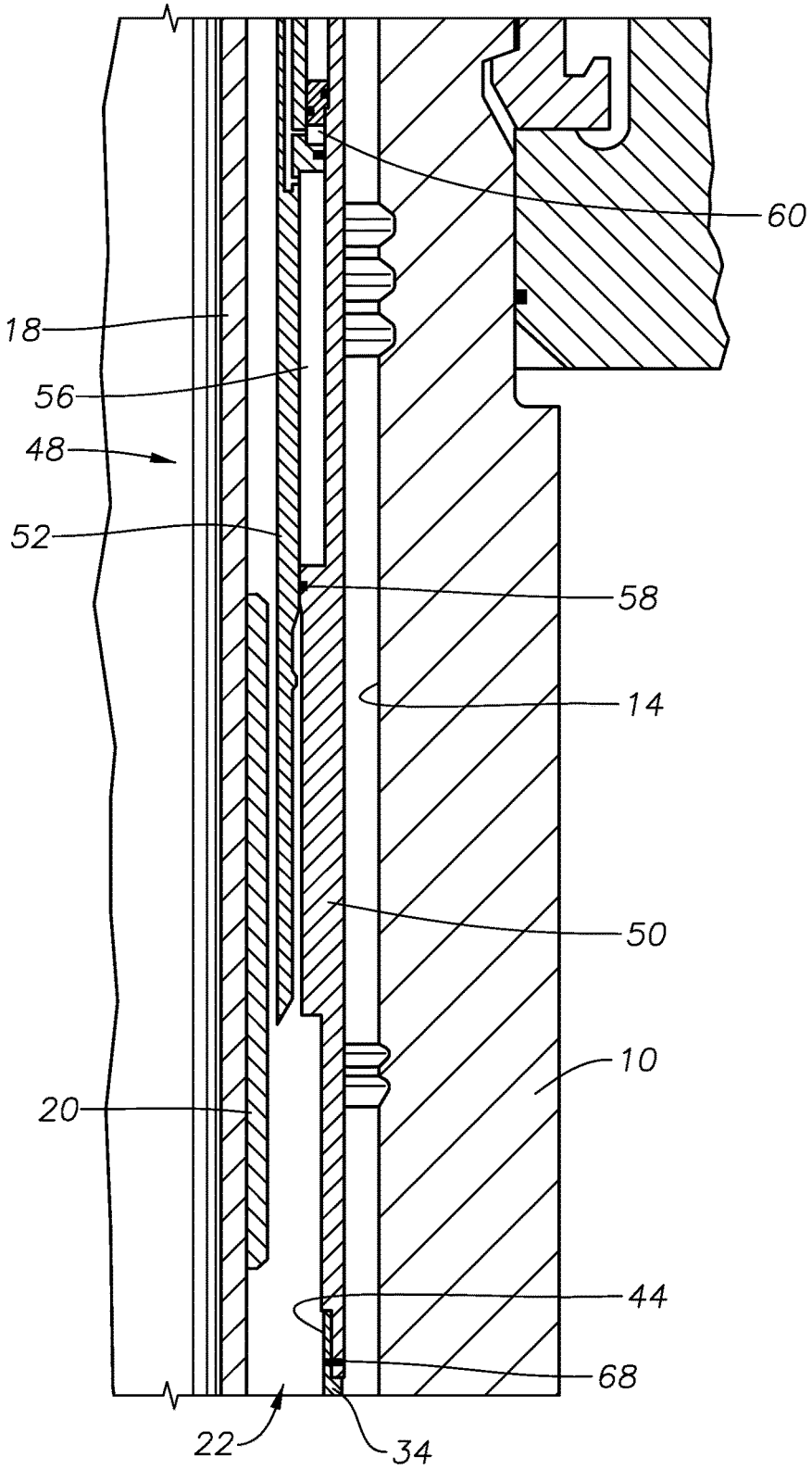
FIG. 3 is a section of an installation tool in accordance with an embodiment of this disclosure, shown located within an outer well member.

Looking at FIGS. 1-3, installation tool 48 is releasably secured to false bowl 34. Installation tool 48 has a hydraulic action arm 50. Hydraulic action arm 50 has a downward facing surface that engages an upward facing surface of false bowl 34. During the installation of hanger assembly 24 into annular space 22, hydraulic action arm 50 is static relative to false bowl 34 until installation tool 48 is released from false bowl 34.

Installation tool 48 includes inner hydraulic arm 52 that is located radially inward of hydraulic action arm 50. Inner hydraulic arm 52 can retain slip bowl 26 in the expanded condition. Inner hydraulic arm 52 can also retain slips 28 in the retracted position. Inner hydraulic arm 52 can be moveable to release slip bowl 26 so that slip bowl 26 can move from the expanded condition to the contracted condition. In the example of FIG. 2, inner hydraulic arm 52 has inner arm injection port 54. Pressure media can be injected through inner arm injection port 54 into inner piston cavity 56. Inner piston cavity 56 is defined by an outer surface of inner hydraulic arm 52 and an inner surface of hydraulic action arm 50. Cavity seals 58 fluidly seal inner piston cavity 56 so that as pressure media is injected into inner piston cavity 56, the increasing forces within inner piston cavity 56 will push inner hydraulic arm 52 axially upward relative to hydraulic action arm 50 and release slip bowl 26 (FIG. 1). Gravity can then cause slip bowl 26 to fall downward until downward facing slip bowl shoulder 40 engages and lands on lower upward facing false bowl shoulder 38. As slip bowl 26 moves downward within false bowl 34, upper upward facing false bowl shoulder 42 engages the outer surface of slip bowl 26 to help transition slip bowl 26 from the expanded condition (FIG. 2) to the contracted condition (FIG. 1).

Looking at FIG. 3, in an alternate embodiment, if gravity is insufficient to cause slip bowl 26 to move downward until downward facing slip bowl shoulder 40 engages and lands on lower upward facing false bowl shoulder 38, inner hydraulic arm 52 can be used to push slip bowl 26 downward relative to false bowl 34. In the example of FIG. 3, pressure media can be injected into second inner piston cavity 60. Second inner piston cavity 60 is also is defined by an outer surface of inner hydraulic arm 52 and an inner surface of hydraulic action arm 50 and sealed with cavity seals 58. However, second inner piston cavity 60 is located so that pressure media injected into second inner piston cavity 60 can cause inner hydraulic arm 52 to move downward and push slip bowl 26 axially to the engaged position where downward facing slip bowl shoulder 40 engages and lands on lower upward facing false bowl shoulder 38.

In the example embodiment of FIGS. 1-2, installation tool 48 further includes outer hydraulic arm 62 that is located radially outward from hydraulic action arm 50. Outer hydraulic arm 62 can be releasably secured to false bowl 34 and can be moveable to release false bowl 34. Outer hydraulic arm 62 has outer arm injection port 64. Pressure media can be injected into outer inner arm injection port 64 into outer piston cavity 66. Outer piston cavity 66 is defined by an outer surface of hydraulic action arm 50 and an inner surface of outer hydraulic arm 62. Cavity seals 58 fluidly seal outer piston cavity 66 so that as pressure media is injected into outer piston cavity 66, the increasing forces within outer piston cavity 66 will push outer hydraulic arm 62 axially upward relative to hydraulic action arm 50 and release false bowl 34. Outer hydraulic arm 62 can be releasably secured to false bowl 34 with releasable connector 68 such as a shear pin, shear coupon, or other suitable means, that will shear or release when outer hydraulic arm 62 is moved axially relative to hydraulic action arm 50 and false bowl 34.

In the embodiment of FIG. 3, outer hydraulic arm 62 is not included and hydraulic action arm 50 is instead releasably secured to false bowl 34. In such an embodiment, hydraulic action arm 50 will move relative to false bowl 34 to release false bowl 34 from installation tool 48. As an example, if pressure media was injected into second inner piston cavity 60 and inner hydraulic arm 52 moves axially downward until downward facing slip bowl shoulder 40 engages and lands on lower upward facing false bowl shoulder 38 and inner hydraulic arm 52 can no longer move downward relative to slip bowl 26, further injection of pressure media into second inner piston cavity 60 can cause hydraulic action arm 50 to move axially upward relative to false bowl 34, so that false bowl 34 is released from installation tool 48. In other alternate embodiments, outer hydraulic arm 62 or hydraulic action arm 50 can be releasably secured to false bowl 34 with releasable connector 68, that will shear or release when outer hydraulic arm 62 or hydraulic action arm 50, as applicable, is moved rotationally relative to false bowl 34.

After installation tool 48 releases false bowl 34, downward facing landing shoulder 36 of false bowl 34 can land on, engage, and be supported by support shoulder 16 of outer well member 10. Alternately, installation tool 48 can push downward facing landing shoulder 36 of false bowl 34 into engagement with support shoulder 16 of outer well member 10 before releasing false bowl 34. After releasing false bowl 34, installation tool 48 can return to the surface while the other components of hanger assembly 24 remain in annular space 22 (FIG. 1, left side).

In an example of operation, if during a drilling or production operation, tubular member 18 is stuck and a slips assembly is required to secure tubular member 18 within outer well member 10, a portion of tubular member 18 that extends out of the well can be gripped while hanger assembly 24 is slid over the top end of tubular member 18. The top end of tubular member 18 can then be gripped so that hanger assembly 24 can be lowered into annular space 22 with installation tool 48. In this way, tubular member 18 is never free standing within outer well member 10, but is always supported by either an external grip, such as the elevator, until hanger assembly 24 is in place and supporting tubular member 18.

Looking at FIG. 2, as hanger assembly 24 is lowered into outer well member 10 with installation tool 48, installation tool 48 retains slip bowl 26 in the expanded condition so that hanger assembly can pass over any collars 20 of tubular member 18. Slips 28 can be held in the retracted position so that the innermost diameter of teeth 29 is greater than an inner diameter of slip bowl 26 and slips 28 will not interfere with the installation of hanger assembly 24 in annular space 22.

Looking at FIG. 1, when hanger assembly 24 nears support shoulder 16 of outer well member 10, slip bowl 26 can be released from installation tool 48 so that downward facing slip bowl shoulder 40 lands on and engages lower upward facing false bowl shoulder 38 and slip bowl 26 is in the contracted condition. Slip bowl 26 transitions between the expanded and contracted positions by engaging upper upward facing false bowl shoulder 42 that is located on an inner diameter of false bowl 34.

In order to release slip bowl 26 from installation tool 48, pressure media can be injected through inner arm injection port 54 into inner piston cavity 56, pushing inner hydraulic arm 52 axially upward relative to hydraulic action arm 50. Gravity can cause downward facing slip bowl shoulder 40 to land on upward facing false bowl shoulder 38, or inner hydraulic arm 52 can push slip bowl 26 downward onto upward facing false bowl shoulder 38.

Next, false bowl 34 can be released from installation tool 48 so that downward facing landing shoulder 36 engages support shoulder 16 (FIG. 1, left side). Slips 28 will be in an extended position for gripping and supporting tubular member 18. Installation tool 48 can then be removed from outer well member 10.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A hanger assembly for supporting a tubular member within an outer well member having a central axis, the hanger assembly comprising:

a slip bowl, the slip bowl being a cylindrical member moveable between an expanded condition with an enlarged diameter and a contracted condition with a reduced diameter, the slip bowl having a downward facing slip bowl shoulder on an outer diameter of the slip bowl;

slips carried by the slip bowl, the slips having teeth on an inner diameter surface of the slips, the slips being moveable between a retracted position where an innermost diameter of the teeth is greater than an inner diameter of the slip bowl, and an extended position where the teeth protrude radially inward from the inner diameter of the slip bowl; and a false bowl, the false bowl being a cylindrical member having a lower upward facing false bowl shoulder located on an inner diameter of the false bowl and sized to selectively engage the downward facing slip bowl shoulder, the false bowl further having a downward facing landing shoulder located on an outer diameter of the false bowl and sized to selectively engage a support shoulder of the outer well member, the false bowl extending axially upward from the downward facing landing shoulder.

2. The hanger assembly according to claim 1, further comprising an installation tool, the installation tool being releasably secured to the false bowl.

3. The hanger assembly according to claim 1, further comprising an installation tool having an inner hydraulic arm, the inner hydraulic arm selectively retaining the slip bowl in the expanded condition.

4. The hanger assembly according to claim 1, further comprising an installation tool having an inner hydraulic arm, the inner hydraulic arm moveable to selectively push the slip bowl axially relative to the false bowl to an engaged position where the downward facing slip bowl shoulder engages the lower upward facing false bowl shoulder.

5. The hanger assembly according to claim 1, further comprising an installation tool having an outer hydraulic arm that is releasably secured to the false bowl, the outer hydraulic arm moveable to release the installation tool from the false bowl.

6. The hanger assembly according to claim 1, further comprising an installation tool having a hydraulic action arm and an inner hydraulic arm, the hydraulic action arm statically engaging the false bowl while the inner hydraulic arm moves the slip bowl relative to the false bowl.

7. The hanger assembly according to claim 1, further comprising an installation tool having:

a hydraulic action arm statically engaging the false bowl;

an inner hydraulic arm located radially inward of the hydraulic action arm, the inner hydraulic arm moveable relative to the hydraulic action arm to release the slip bowl and allow the slip bowl to move axially relative to the false bowl to an engaged position where the downward facing slip bowl shoulder engages the lower upward facing false bowl shoulder; and an outer hydraulic arm located radially outward from the hydraulic action arm and releasably secured to the false bowl, the outer hydraulic arm moveable relative to the hydraulic action arm to release the installation tool from the false bowl.

8. The hanger assembly according to claim 1, wherein the false bowl has an upper upward facing false bowl shoulder located on the inner diameter of the false bowl, the upper upward facing false bowl shoulder having a sloped surface selectively engaging an outer surface of the slip bowl as the slip bowl moves axially relative to the false bowl.

9. The hanger assembly according to claim 1, wherein the false bowl has an upper upward facing false bowl shoulder located on the inner diameter of the false bowl, a region of larger inner diameter above the upper upward facing false bowl shoulder and a region of smaller inner diameter below the upper upward facing false bowl shoulder, and wherein when the slip bowl is in the expanded condition, a portion of the slip bowl is located axially above the upper upward facing false bowl shoulder and when the slip bowl is in the contracted condition, the region of smaller inner diameter circumscribes the slip bowl.

10. A hanger assembly for supporting a tubular member within an outer well member having a central axis, the hanger assembly comprising:

a slip bowl, the slip bowl moveable between an expanded condition with an enlarged diameter and a contracted condition with a reduced diameter, the slip bowl having a downward facing slip bowl shoulder on an outer diameter of the slip bowl;

slips carried by the slip bowl, the slips having teeth on an inner diameter surface of the slips;

a false bowl, the false bowl having a lower upward facing false bowl shoulder located on an inner diameter of the false bowl and sized to selectively engage the downward facing slip bowl shoulder, the false bowl further having a downward facing landing shoulder located on an outer diameter of the false bowl and sized to selectively engage a support shoulder of the outer well member; and an installation tool releasably secured to the false bowl, the installation tool having a hydraulic action arm and an inner hydraulic arm, the hydraulic action arm having a downward facing surface that engages an upward facing surface of the false bowl, and the inner hydraulic arm selectively retaining the slip bowl in the expanded condition.

11. The hanger assembly according to claim 10, wherein the installation tool has an outer hydraulic arm that is releasably secured to the false bowl, the outer hydraulic arm moveable to release the installation tool from the false bowl.

12. The hanger assembly according to claim 10, wherein the inner hydraulic arm is located radially inward of the hydraulic action arm, the inner hydraulic arm moveable relative to the hydraulic action arm to selectively push the slip bowl axially relative to the false bowl to an engaged position where the downward facing slip bowl shoulder engages the lower upward facing false bowl shoulder, and wherein the installation tool further includes an outer hydraulic arm located radially outward from the hydraulic action arm and releasably secured to the false bowl, the outer hydraulic arm moveable relative to the hydraulic action arm to release the installation tool from the false bowl.

13. The hanger assembly according to claim 10, wherein the false bowl has an upper upward facing false bowl shoulder located on the inner diameter of the false bowl, the upper upward facing false bowl shoulder having a sloped surface selectively engaging an outer surface of the slip bowl as the slip bowl moves axially relative to the false bowl.

14. The hanger assembly according to claim 10, wherein the false bowl has an upper upward facing false bowl shoulder located on the inner diameter of the false bowl, a region of larger inner diameter above the upper upward facing false bowl shoulder and a region of smaller inner diameter below the upper upward facing false bowl shoulder, and wherein when the slip bowl is in the expanded condition, a portion of the slip bowl is located axially above the upper upward facing false bowl shoulder and when the slip bowl is in the contracted condition, the region of smaller inner diameter circumscribes the slip bowl.

15. A method for supporting a tubular member within an outer well member having a central axis, the method comprising:

providing a hanger assembly, the hanger assembly having a slip bowl, slips carried by the slip bowl, and a false bowl, the slip bowl being a cylindrical member moveable between an expanded condition with an enlarged diameter and a contracted condition with a reduced diameter, the slips being moveable between a retracted position where an innermost diameter of teeth of the slips located on an inner diameter surface of the slips is greater than an inner diameter of the slip bowl, and an extended position where the teeth protrude radially inward from the inner diameter of the slip bowl, and the false bowl being a cylindrical member;

inserting the hanger assembly into the outer well member with an installation tool, the installation tool retaining the slip bowl in the expanded condition;

releasing the slip bowl from the installation tool so that a downward facing slip bowl shoulder on an outer diameter of the slip bowl engages a lower upward facing false bowl shoulder located on an inner diameter of the false bowl and the slip bowl moves to the contracted condition; and releasing the false bowl from the installation tool so that a downward facing landing shoulder located on an outer diameter of the false bowl engages a support shoulder of the outer well member and the slips are in the extended position for gripping and supporting the tubular member.

16. The method according to claim 15, wherein the installation tool has an inner hydraulic arm, and wherein the step of inserting the hanger assembly into the outer well member with the installation tool includes retaining the slip bowl in the expanded condition with the inner hydraulic arm.

17. The method according to claim 15, wherein the installation tool has an inner hydraulic arm, and wherein the step of releasing the slip bowl from the installation tool further comprises pushing the slip bowl axially relative to the false bowl with the inner hydraulic arm until the downward facing slip bowl shoulder engages the lower upward facing false bowl shoulder.

18. The method according to claim 15, wherein the installation tool has an outer hydraulic arm that is releasably secured to the false bowl, and wherein the step of releasing the false bowl from the installation tool includes moving the outer hydraulic arm relative to the false bowl to release the outer hydraulic arm from the false bowl.

19. The method according to claim 15, wherein the installation tool has a hydraulic action arm, an inner hydraulic arm located radially inward of the hydraulic action arm, and an outer hydraulic arm located radially outward from the hydraulic action arm, and wherein the method includes statically engaging the false bowl with the hydraulic action arm, moving the inner hydraulic arm relative to the hydraulic action arm to selectively push the slip bowl axially relative to the false bowl until the downward facing slip bowl shoulder engages the lower upward facing false bowl shoulder, and moving the outer hydraulic arm relative to the hydraulic action arm to release the installation tool from the false bowl.

20. The method according to claim 15, wherein the false bowl has an upper upward facing false bowl shoulder located on the inner diameter of the false bowl, and wherein the step of releasing the slip bowl from the installation tool includes engaging a sloped surface of the upper upward facing false bowl shoulder with an outer surface of the slip bowl as the slip bowl moves axially relative to the false bowl and the slip bowl moves from the expanded condition to the contracted condition.

* * * * *